United States Patent [19]

McGlennon

[11] 4,303,012

[45] Dec. 1, 1981

[54] LOAD MULTIPLYING MECHANISMS

[76] Inventor: Gordon L. McGlennon, 13, Llantwit Rd., Pontypridd, Mid-Glamorgan, Wales

[21] Appl. No.: 67,799

[22] Filed: Aug. 20, 1979

[30] Foreign Application Priority Data

Aug. 26, 1978 [GB] United Kingdom ..... 34762/78

[51] Int. Cl.[3] ..... B30B 1/16

[52] U.S. Cl. ..... 100/272; 74/479; 74/512; 74/520; 251/58; 251/280

[58] Field of Search ..... 74/469, 512, 516, 520, 74/523, 522.5, 106, 479; 108/81; 100/272; 251/58, 279, 280

[56] References Cited

U.S. PATENT DOCUMENTS

| | | | |
|---|---|---|---|
| 872,885 | 12/1907 | Anderson | 100/272 |
| 986,809 | 3/1911 | Derbyshire et al. | 100/272 |
| 1,007,792 | 11/1911 | Orton | 100/272 X |
| 2,298,852 | 10/1942 | Ward | 100/272 UX |
| 3,910,133 | 10/1975 | Oestmann | 74/512 X |
| 3,926,033 | 12/1975 | Forichon | 100/272 X |
| 4,034,666 | 7/1977 | Bigun et al. | 100/272 X |
| 4,133,260 | 1/1979 | Gundal | 100/272 X |

FOREIGN PATENT DOCUMENTS

| | | | |
|---|---|---|---|
| 574122 | 4/1959 | Canada | 100/272 |
| 1154928 | 4/1958 | France | 100/272 |
| 456352 | 7/1968 | Switzerland | 100/272 |

*Primary Examiner*—C. J. Husar
*Assistant Examiner*—Moshe I. Cohen
*Attorney, Agent, or Firm*—Trexler, Bushnell & Wolters, Ltd.

[57] ABSTRACT

A pneumatically operated press in which the moving press plunger (13) is actuated by a toggle linkage (20, 21, 22) which is itself actuated by a second toggle linkage (30, 31, 32). The end link (31) of this second linkage is actuated by a large diameter pneumatic ram (34) while the pivotal point (32) of this second toggle linkage is connected to a relatively small diameter pneumatic ram (36), or some other actuator. An automatic switch (42, 32) engages a valve to admit air to the larger ram (34) when the smaller ram (36) has moved the second toggle (30, 31) into an in-line position. The ram (36) may be replaced by a manual operating lever.

11 Claims, 4 Drawing Figures

LOAD MULTIPLYING MECHANISMS

This invention relates to load multiplying mechanisms intended for exerting very heavy loads on a movable active output element of a press tool in which the active element is in the form of a movable plunger designed to bear down on a workpiece supported on a work table.

Existing mechanisms of this type suffer from various disadvantages. The power input or actuator is often a fluid-operated ram or motor, and if the multiplying ratio is sufficiently large even a small size ram can produce a very substantial output force. However, the large ratio also necessitates a substantial travel of the ram and this consumes excessive quantities of fluid under pressure. It is an object of the invention accordingly to provide an improved load multiplying mechanism which will avoid some of the disadvantages of existing devices.

It is an object of the invention to provide an improved press having a load multiplying mechanism including a first toggle linkage acting on an active output plunger of the press, a second toggle linkage arranged to act on the first linkage, a main fluid ram acting on one end of the second linkage, and a further actuator connected to the pivot joint of the second linkage.

Thus, in a preferred construction the first toggle linkage has two links pivotally inter-connected, and pivotally attached at their ends respectively to an abutment and to the active output plunger, and the second toggle linkage has two links pivotally interconnected, one link pivotally attached to the interconnection between the two links of the first toggle linkage, and the other link pivotally attached to the main fluid ram, and the second actuator is connected to the pivotal link inter-connection of the second toggle linkage.

The invention is particularly applicable to a mechanism in which the two power actuators are both fluid-operated rams, and according to another preferred feature of the invention, the main ram is of larger effective piston area than the second ram. Thus, the smaller size of the second ram allows it to be used economically to shift the second toggle linkage into an in-line attitude before the main ram is actuated. In doing so, the first toggle linkage is moved closer to its in-line attitude so that the extent of movement after the main ram comes into operation is minimised.

It is important that the main ram and the second actuator should be operated in the correct sequence and timing, and according to another preferred feature of the invention the mechanism includes means to ensure that the second actuator moves the second toggle linkage substantially into an in-line attitude before the main ram is effectively or fully operated.

Since the double toggle linkage can exert a very considerable output load and produce a very high multiplying ratio, there is a risk of damage occurring, and according to another preferred feature of the invention the mechanism includes a resilient safety device acting on either one or both of the toggle linkages to prevent overload. For example, the first toggle linkage may include a mechanical spring and the main fluid ram may include or be associated with a resilient cushioning device.

The invention may be performed in various ways, and one specific embodiment will now be described by way of example, with reference to the accompanying drawings, in which.

Figure 2:
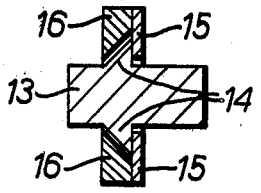
FIG. 2 is a diagrammatic sectional plan view showing the moving plunger of the press tool.

In this example, the invention is applied to a press or press tool for performing forming or shaping operations on workpieces. The press tool includes a heavy frame 10 including a base 11 which supports a table 12 on which the workpiece is mounted. Above the table is a movable plunger 13 which is intended to carry a die or other forming member attached to its lower extremity and which is guided in the frame of the press as illustrated in FIG. 2. The plunger 13 has projections 14 on opposite sides which are guided between a back plate 15 and a gib 16 secured to the frame of the press.

The load multiplying mechanism is mounted on the upper part of the frame 10 and is designed to exert a very substantial downward force on the plunger 13. This mechanism includes a first toggle linkage consisting of an upper link 20 and a lower link 21 pivotally interconnected at 22. The lower link 21 is connected by a ball joint 23 to the plunger 13 and the upper link 20 is pivotally attached at 24 to a member 25 which is itself pivotally connected at 26 to a heavy transverse beam 27 which acts as the fixed abutment or anchorage of this toggle linkage. It will be appreciated that when the pivotal inter-connection 22 is moved generally horizontally to the left in FIG. 1 the plunger 13 will be forced downwards and the linkage will generate a large multiplying ratio.

The second toggle linkage consists of a left hand link 30 and a right hand link 31, both pivotally inter-connected at 32, the left hand link being pivotally attached also to the inter-connection 22 of the first toggle linkage. The right hand link 31 is pivotally connected at 33 to a first pneumatic actuator or ram 34. The pivotal inter-connection 32 of the second toggle linkage is connected to the piston rod 35 of a second pneumatic actuator 36 carried by a bracket 37 attached to the frame of the press.

This second pneumatic actuator 36 is of considerably smaller effective piston area than the first actuator 34. It can thus travel an appreciable distance with economic consumption of compressed air. In this first part of the operating movement of the complete mechanism the second toggle linkage 30, 31 is moved towards an in-line condition from a starting position indicated in chain lines at 40. In this first part of the movement the plunger 13 does not normally exert any load on the workpiece and the comparatively small piston area of the actuator 36 is no disadvantage.

When the second actuator 36 has retracted fully and the second linkage 30,31 is substantially in an in-line attitude as illustrated, a pivoted cam 42 attached to the right hand link 31 bears down on a pivoted lever 43 connected to a pneumatic valve to be described which then actuates the first pneumatic actuator 34. This actuator 34 has a piston 45 of larger effective piston area and the full force of this piston is then exerted on the links 30, 31 in-line connected to the central pivot 22 of the first toggle linkage. It will be noted from the drawings that the two links of the said first toggle linkage are out of line at this stage. A very heavy downward output load is then exerted on the plunger 13 during the final movement of the first toggle linkage towards its in-line condition.

It will be appreciated that by the inherent nature of a toggle linkage the multiplying ratio increases progressively as the linkage moves towards its in-line condition. The theoretical maximum load exerted may be almost unlimited. If the press is not operated correctly or if it is not set up properly for any particular workpiece, excessive loads may be generated which may cause damage to the workpiece or to the frame of the press or to the component parts of the mechanism. Accordingly, the first toggle linkage is provided with a resilient safety device in the form of a mechanical spring. The member 25 which is pivotally connected between the upper toggle link 20 and the fixed beam or anchorage 27, has a projecting arm 47 which engages on the underside of a shock absorber or cushion element 48 whose upper end is held down by an abutment plate attached to a bracket 50 secured at its lower end to a rigid part of the machine frame. The cushion element may be provided with an adjustable device for varying the degree of pre-compression. In place of a mechanical cushion the shock absorber may be in the form of a pre-loaded pneumatic piston and cylinder, fitted with a controlled pressure relief system.

Thus it will be seen that if an excessive load arises within the toggle linkage 20, 21 the leverage effect produced by the extended length of the arm 47 in relation to the distance between the two pivot points 26, 24 will produce an increased load on the cushion element 48 and the arm 47 can therefore move slightly to accommodate this excess load.

There is some risk of overload and of strain or damage to the mechanism in the operation of the second toggle linkage 30, 31. This might occur for instance if the operator places an oversize workpiece on the table 12 such that the plunger 13 engages the workpiece while the second pneumatic ram 36 is being retracted and before the first actuator or ram 34 has come into operation. The actuator 36 acting on the toggle linkage 30, 31 could generate very large forces in the mechanism. To overcome this problem the cylinder 60 of the ram 34 is formed with a rear chamber 61 of slightly increased diameter relative to the main piston 45 and a movable end wall 62 separates this chamber from the main chamber of the ram. A pressure conduit 63 admits compressed air at a constant pressure of 80 p.s.i. to the chamber 61, thus urging the movable end wall 62 to the left in FIG. 1 towards the main ram piston 45. A further conduit 64 admits compressed air at the same pressure via appropriate control valves to the main operating cylinder. Thus it will be seen that if the force generated within the second toggle linkage 30, 31 is excessive the ram piston 45 will be forced back until it engages the movable end wall 62 and this in turn will be urged back against the pressure of the air within the subsidiary chamber 61. The distance involved in this travel is sufficient to relieve the mechanism of any such excess load liable to cause damage.

Figure 3:
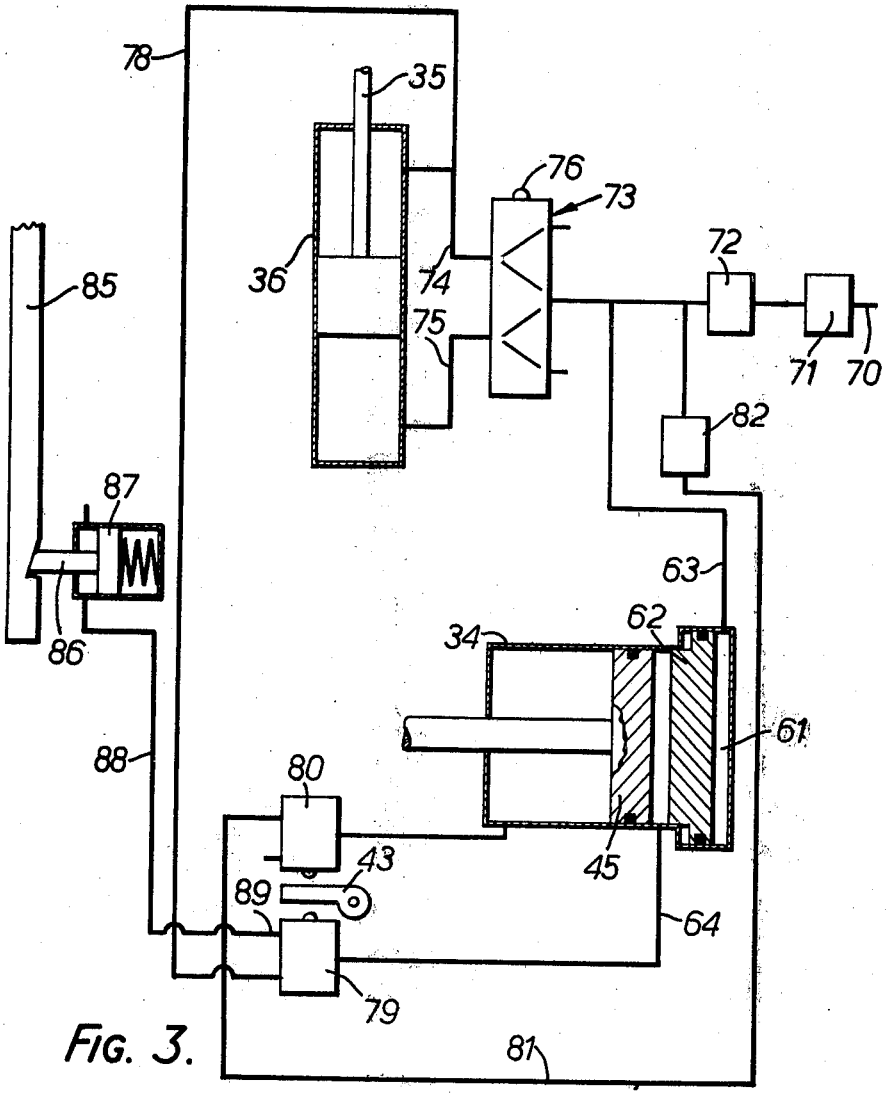
FIG. 3 is a diagram illustrating the main components of the pneumatic circuit for controlling the tool.

FIG. 3 illustrates the pneumatic circuit for controlling the operation of the various elements of the mechanism. The main compressed air supply line 70 leads via a manual on/off valve 71 to a pressure control unit 72 arranged to provide an outlet pressure of 80 p.s.i. From this controller compressed air is supplied to a reversing valve 73 connected to output conduits 74, 75 attached to the double acting pneumatic ram 36. The valve 73 is actuated by a movable element 76 to connect one or other of the two lines 74, 75 to pressure and the other to relief.

The line 74 is also connected via conduit 78 to an on/off valve 79 actuated by the lever 43 referred to above. This controls the flow to the conduit 64 leading to the main cylinder of the first pneumatic actuator 34. Also associated with the lever 43 is a further on/off valve 80 connected into a low pressure air line 81 leading to the opposite end of the pneumatic ram 34 and connected to the main compressed air supply through a pressure reducer 82 arranged to produce an output of 10 p.s.i.

The press 2 is provided with a vertically movable protective gate or guard 85 which can move down in front of the work on the table 12 to ensure that the operator's hands are clear before the machine is actuated. This guard 85 is counterbalanced and is spring urged upwards. When lowered it is held in position by a spring catch 86, the catch being attached to a small pneumatic piston 87 in a cylinder with a permanent bleed vent, air being supplied via a conduit 88 attached to the exhaust outlet 89 of the valve 79.

The system is thus largely automatic in operation to produce a repeating cycle. When the guard 85 is lowered by the operator it engages the valve 73 and automatically supplies pressure to the line 74 which urges the ram 36 downwards, thus starting the operation of the toggle linkage. When the linkage 30, 31 is substantially straight the gravity cam 42 engages the lever 43 and opens the valve 79 to allow compressed air to be admitted to the pneumatic ram 34, thus starting the second stage of the power cycle. As the links 30, 31 move to the left the gravity cam 42 moves clear of the end of the pivoted lever 43 which thus lifts, thus closing the valve 79 and opening the valve 80. This applies low pressure air at 10 p.s.i. to the reverse side of the ram 34 so as to withdraw the toggle mechanism and in doing so the exhuast from this ram issuing from port 89 operates the ram 87 to release the catch 86. The gate 85 is thus urged upwards by its spring and so automatically reverses the position of the valve 73 so that the pneumatic ram 36 is also reversed and extends upwards to its starting position ready for the start of the next cycle.

The gravity cam 42 is preferably so arranged that it will run off the end of the lever 43 a short distance, (say 1.5 mm.) before the toggle links 20, 21 move into their accurate aligned attitude. This avoids waste of air in the last small increment of travel, which is not of great practical value in most conditions.

Figure 1:
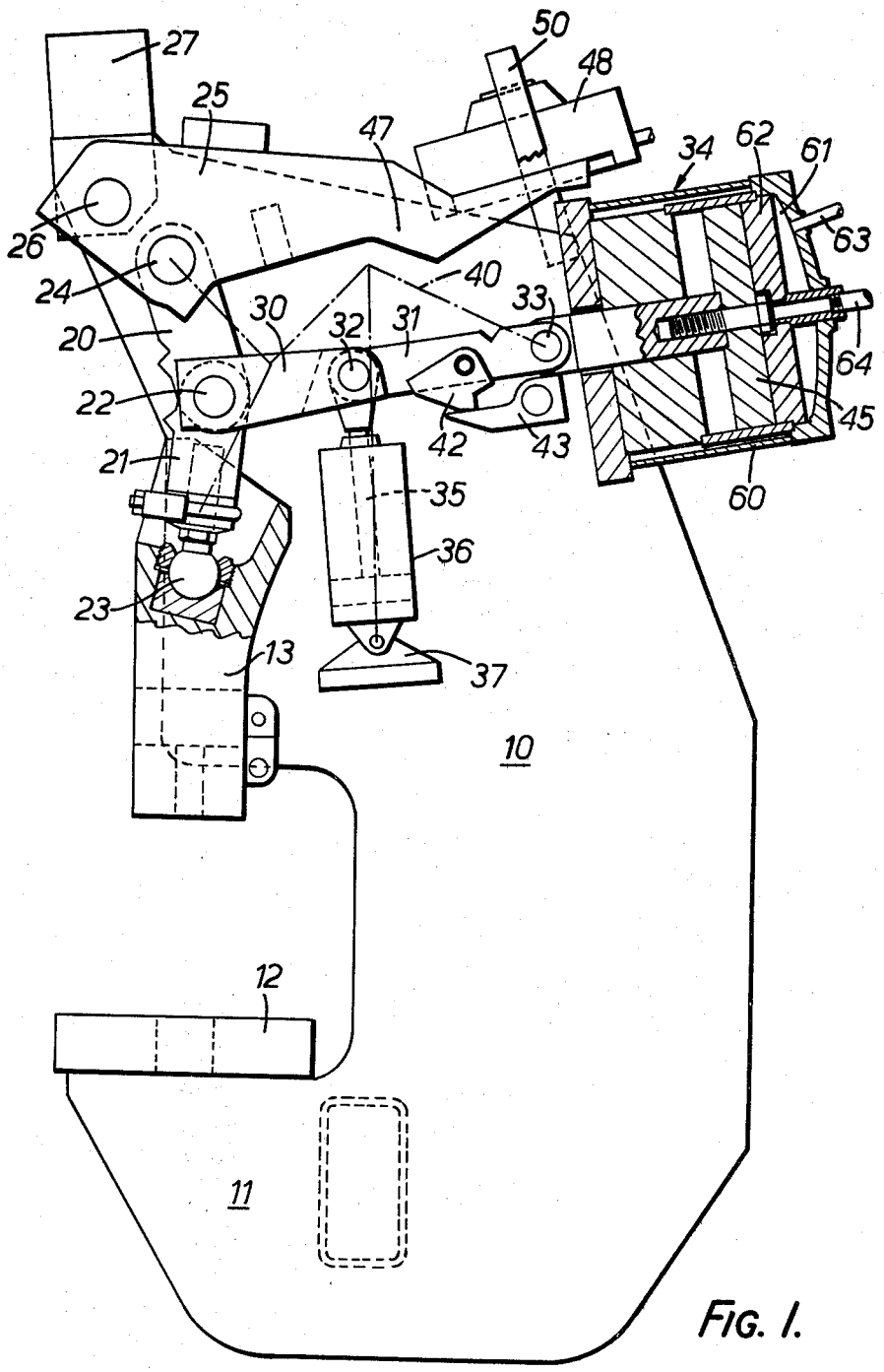
FIG. 1 is a somewhat diagrammatic side elevation partly in section, illustrating the main components of a press tool according to the invention.
Figure 4:
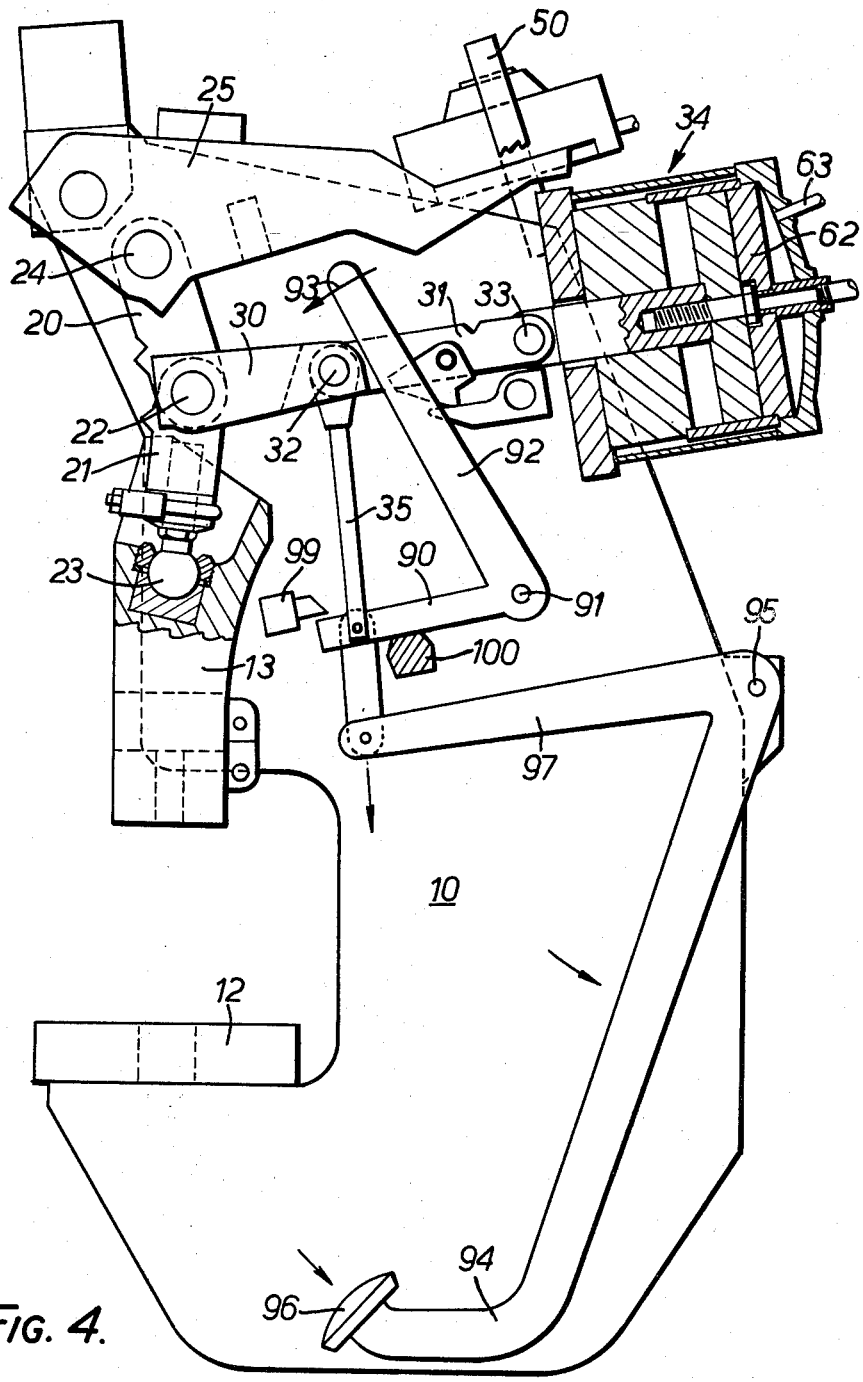
FIG. 4 is a diagrammatic side elevation illustrating a modified operating mechanism for the machine of FIG. 1.

FIG. 4 is a diagrammatic side elevation, in section, illustrating a modified form of the machine in FIGS. 1 to 3. In this modification the second pneumatic ram actuator 36 is omitted and replaced by manual and foot operated lever mechanisms. The lower end of the actuator rod 35 is connected to a lever 90 mounted to rotate on a shaft 91 supported in bearings in the machine frame, the lever 90 being fixed to a hand lever 92 which can be pulled forwards in the direction of the arrow 93 in order to pull the rod 35 downwards until the pivot 32 is in the in-line position as illustrated. Subsequently, the second pneumatic actuator 34 is operated in the manner described above to apply force to the main toggle pivot 22. Since the heavy loading occurs in most instances only during this final stage, the effort required on the hand lever 92 can be comparatively small.

Alternatively, or in addition, the machine also includes a foot-operated mechanism for the same purpose. A foot pedal bell crank lever 94 is pivoted in the machine frame at 95 and has a pedal 96 at its free end. The upper arm 97 of the bell crank is coupled to the rod 35 via a short pivotal link. Depressing the foot pedal likewise moves the toggle pivot 32 downwards for the same purpose described above.

In all these examples means are provided to hold the linkage 30, 31, 32 in the straight position while force is applied by the actuator, 34. The ram 36 is suitably dimensioned and positioned for this purpose, and likewise the hand lever 92, and/or the pedal mechanism 94, 97, are suitably dimensioned, and may be provided with a detent or lock 99 and a stop 100 to hold them in the correct limiting position.

In most toggle linkages the path of movement of the articulated pivot passes between the two remote pivots of the two links, but in some cases one link is longer than the other and the articulated pivot passes outside the two remote pivots, and the invention contemplates both forms.

By using a manual lever to shift the second linkage into an in-line position, the cost and complexity of the machine can be reduced, while retaining high loading potential with minimum consumption of pressurised air. The manual operating phase involves relatively low effort.

I claim:

1. A power operated press including a frame having a base with worktable, means to support a plunger for movement towards and away from the worktable, and means for actuating the plunger including a first toggle linkage comprising two links pivotally interconnected at an articulated joint, the links being respectively connected pivotally to the frame and the plunger, and a second toggle linkage comprising two further links pivotally interconnected at an articulated joint, one of the said further links being connected to the joint of the first toggle linkage, and including means for actuating the said toggle linkages to cause movement of said plunger and generate a potential output force thereat, including a main power-operated fluid ram acting on the second of the two links of the second toggle linkage, and a further actuator connected to the articulated joint of the said second toggle linkage.

2. A press according to claim 1, including means responsive to movement of said second toggle into a substantially straight in-line attitude, and valve means operated thereby automatically to energise said main fluid ram.

3. A press according to claim 1, in which said further actuator is manually operated.

4. A press according to claim 1, in which the two links of said first toggle linkage are out of line when the links of said second toggle linkage are in line before actuation of said main ram.

5. A press according to claim 1, in which said further actuator also constitutes a fluid operated ram.

6. A press according to claim 5, in which the ram of said further actuator is of smaller effective piston area than the effective area of said main ram.

7. A press according to claim 1, including a resilient overload device, operatively connected to one of said toggle linkages, to limit the output force exerted by said plunger.

8. A press according to claim 7, in which said overload device is connected between said frame and the respective link of the first toggle linkage.

9. A press according to claim 7, in which said resilient overload device includes a resilient element connected to a load-multiplying lever, said lever being connected to a part of said toggle linkages.

10. A press according to claim 7, wherein said resilient overload device is operatively connected to said second toggle linkage.

11. A press according to claim 7, wherein said resilient overload device includes a fluid-filled piston and cylinder unit.

* * * * *